United States Patent [19]

Kuroiwa et al.

[11] 4,280,462

[45] Jul. 28, 1981

[54] ELECTRONICALLY CONTROLLED CARBURETOR FOR INTERNAL COMBUSTION ENGINE

[75] Inventors: Hiroshi Kuroiwa, Hitachi; Yoshishige Oyama, Katsuta, both of Japan

[73] Assignee: Hitachi, Ltd., Tokyo, Japan

[21] Appl. No.: 56,237

[22] Filed: Jul. 10, 1979

[30] Foreign Application Priority Data

Aug. 11, 1978 [JP] Japan ..... 53-97243

[51] Int. Cl.[3] ..... F02M 23/04

[52] U.S. Cl. ..... 123/437; 261/DIG. 78

[58] Field of Search ..... 123/119 EC, 32 EE, 32 EA, 123/119 A; 261/DIG. 78, DIG. 74

[56] References Cited

U.S. PATENT DOCUMENTS

| | | | |
|---|---|---|---|
| 3,802,402 | 4/1974 | Swatman | 123/119 A |
| 3,814,389 | 6/1974 | August | 261/DIG. 78 |
| 3,901,202 | 8/1975 | Hollis, Jr. et al. | 123/119 A |
| 3,983,189 | 9/1976 | Taylor | 261/DIG. 74 |
| 4,135,482 | 1/1979 | Bier et al. | 123/119 EC |
| 4,169,439 | 10/1979 | Tsiang et al. | 123/119 EC |
| 4,172,433 | 10/1979 | Bianchi et al. | 123/32 EE |
| 4,173,956 | 11/1979 | Ikeura et al. | 123/119 EC |

FOREIGN PATENT DOCUMENTS 2654988 12/1975 Fed. Rep. of Germany ... 261/DIG. 78

*Primary Examiner*—Charles J. Myhre
*Assistant Examiner*—R. A. Nelli
*Attorney, Agent, or Firm*—Craig and Antonelli

[57] ABSTRACT

An electronically-controlled carburetor is disclosed. This electronically-controlled carburetor is provided with a control fuel path in addition to a main fuel path opened to the venturi of the air horn. This control fuel, after being introduced to a constant pressure chamber regulated at a constant pressure, is further introduced to the air horn through a sonic flow nozzle provided at the opening of the constant pressure chamber, together with the control air introduced to the constant pressure chamber. The amount of the control fuel introduced to the air horn and the amount of the control air are regulated on the basis of control electrical signals generated by an electronic control circuit supplied with data indicative of engine running conditions. In this way, the air-fuel ratio is properly controlled over the entire range of engine running conditions.

29 Claims, 4 Drawing Figures

ELECTRONICALLY CONTROLLED CARBURETOR FOR INTERNAL COMBUSTION ENGINE

BACKGROUND OF THE INVENTION

The present invention relates to an electronically-controlled carburetor used for an internal combustion engine, or more in particular to an electronically-controlled carburetor in which the air-fuel ratio is corrected by electronic control for attaining a proper air-fuel ratio over all the ranges of engine operation.

In recent years, automotive electronics have made rapid progress, and more electronic devices are being introduced into fuel supply control systems.

Especially, an electronic fuel injection system of multi-injection type with injection valves individually provided in the neighbourhood of the intake port of the respective combustion chambers is in the limelight and finds wide applications. As well known, an electronic fuel injection system is such that the amount of air introduced into the engine is mechanically or electrically detected, and the signal representing the amount of air thus detected is used to control the electrical signal for controlling the opening of the fuel injection valve, thus controlling the air-fuel ratio. In the case where a control circuit for producing a fuel-amount-control-signal in accordance with the air amount signal is arranged such that the circuit constant thereof is variably selectable so that desired air-fuel ratio can be easily achieved by properly selecting the value of the circuit constant. Also, under a particular running condition such as engine cold start, or high-load operation, etc., a signal produced from means for detecting such a particular running condition is transmitted to the above-mentioned control circuit, thus making it possible to attain the desired air-fuel ratio for the particular running condition. In the future when the progress in the electronics may come to require a fine and exact regulation of the fuel supply system in combination of a microcomputer, such a microcomputer can be coupled with the above-mentioned electronic fuel injection system with comparative ease.

The control of air-fuel ratio in the carburetor, on the other hand, depends in many respects on mechanical or hydrodynamic techniques and fewer attempts have been made to control the air-fuel ratio by electrical techniques. The electrical control of the air-fuel ratio has been applied only in certain carburetors which employ what is called the closed-loop control of air-fuel ratio as disclosed in U.S. Pat. No. 4,135,482 for example; in which the actual air-fuel ratio of the mixture gas supplied to the engine is detected by detecting one component of the exhaust gas, and the deviations of the actual air-fuel ratio from a commanded air-fuel ratio are corrected by driving an actuator provided in the fuel path in the carburetor in response to an electrical signal supplied from the control circuit. In the closed-loop control system now being commercialized, an oxygen sensor made of a solid electrolyte of the zirconia group is used as means for detecting one component of the exhaust gas. It is well known that this oxygen sensor produces an output voltage which changes stepwise at or in the vicinity of the stoichiometric air-fuel ratio. This closed-loop system uses a ternary catalyzer capable of purifying the exhaust gas by oxidizing/reducing the obnoxious components of the exhaust gas such as CO, HC and NOx. In view of the fact that the purifying efficiency of the ternary catalyzer is very high only at or near the stoichiometric air-fuel ratio, the output characteristics of the oxygen sensor are utilized to control the actual air-fuel ratio very skillfully at or about the stoichiometric air-fuel ratio. Thus, the carburetor of closed-loop type could not help being arranged such that although the air-fuel ratio of the carburetor can be maintained at or about the stoichiometric value by electrical means, particular air-fuel ratios in other specific operating ranges have to be controlled by mechanical or hydrodynamic means of the carburetor per se irrespectively of the above-mentioned electrical means. Even if an attempt is made in the future to improve the exhaust characteristics and fuel economy or fuel consumption by coupling the carburetor of closed-loop type to a microcomputer with the advance of the electronics, it will be impossible to control the air-fuel ratio over the entire operating ranges by electrical means by simply coupling the carburetor to the micrscomputer. Thus, while the air-fuel ratio control in the electronic fuel injection system can be achieved over the entire operating range by simply coupling a microcomputer thereto as mentioned above, such a control is not easily available in the case of the carburetor. In order that the carburetor of closed-loop type may electrically control the air-fuel ratio in the operating ranges not covered by electrical techniques, actuators are required to be provided at various portions in the carburetor paths. This proportionally complicates the construction of the carburetor and greatly increases the cost thereof.

SUMMARY OF THE INVENTION

Accordingly, it is an object of the present invention to obviate the above-mentioned disadvantages of the prior art technique and provide an electronically-controlled carburetor capable of compensatory control of the air-fuel ratio over the entire engine operating ranges by electrical means.

According to the present invention, there is provided an electronically-controlled carburetor comprising an air horn connected between an external cleaner and an intake manifold of the engine and provided with a venturi and a throttle valve therein, a float chamber containing a liquid fuel, a main fuel path for injecting main fuel supplied from the float chamber into the air horn through a main nozzle opened to the venturi, a constant pressure chamber, means for maintaining the internal pressure of the constant pressure chamber at a predetermined level lower than the atmospheric pressure, a control fuel path for introducing control liquid fuel supplied from the float chamber into the constant pressure chamber, means for controlling the amount of the control liquid fuel passing through the control fuel path, means for introducing the control liquid fuel from the constant pressure chamber to the air horn, and electronic control circuit means for generating a control electrical signal and for applying it to the control fuel passing amount control means so that the amount of the control liquid fuel passing through the control fuel path is controlled such that the air-fuel ratio of the air-fuel mixture supplied to the engine is adjusted in accordance with the running conditions of the engine.

BRIEF DESCRIPTION OF THE DRAWINGS

The above and other objects, features and advantages of the present invention will be made apparent by the detailed description taken in conjunction with the accompanying drawings, wherein.

DESCRIPTION OF THE PREFERRED EMBODIMENTS

Figure 1:
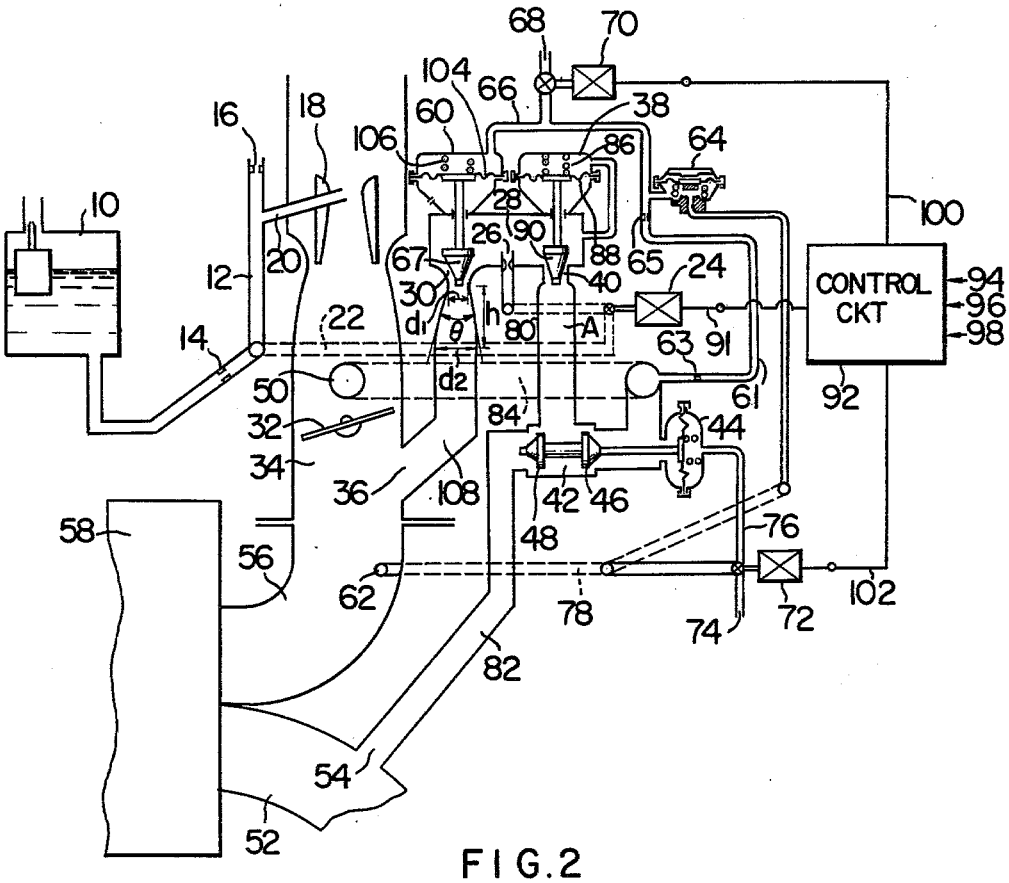
FIG. 1 is a diagram for explaining the essential parts of the electronic control system of the carburetor as an embodiment of the present invention.

The diagram of FIG. 1 is for explaining the essential parts of an electronically-controlled carburetor as an embodiment of the present invention. First, description will be made about the construction thereof. The fuel metered by a main fuel jet 14 provided midway of a main fuel path 12 communicating with a float chamber 10 of the carburetor is mixed with air introduced from an air cleaner (not shown) through a main air bleed 16 and injected to a venturi 18 through a main nozzle 20 which is open to the venturi 18. A control fuel path provided for electronic control of the air-fuel ratio is constructed as described hereunder. The control fuel path 22 branched out of the main fuel path 12 at its portion downstream of the main jet 14 communicates with a constant pressure chamber 28 through an actuator 24 and a control fuel nozzle 26. The constant pressure chamber 28 communicates with an air horn 34 at its portion 36 downstream of a throttle valve 32 through a sonic flow valve 30 on the one hand and with a change-over valve chamber 42 through the opening 40 controlled by a low constant pressure valve 38 on the other hand. The change-over valve 42 includes a pair of valve members 46 and 48 connected in series. When the valve member 46 is opened from its valve seat, the valve member 48 is closed, so that the constant pressure chamber 28 communicates with the air horn 34 at its portion 50 upstream of the throttle valve 32 and downstream of the venturi 18. In the case where the valve member 46 is closed, on the contrary, the valve member 48 is opened, with the result that the constant pressure chamber 28 communicates with an exhaust manifold 52 at its portion 54. The carburetor described above supplies fuel-air mixture to an engine 58 through an intake manifold 56.

Next, the manner in which a sonic flow control valve 60 is controlled will be explained. The pressure at a portion 62 of the air horn 34 downstream of the throttle valve 32 (which is of course lower than the atmospheric pressure) is introduced to a middle constant pressure valve 64 which maintains its output pressure at substantially constant level lower than the atmospheric pressure with the help of fixed orifices 63 and 65 provided in a tube 61 regardless of the magnitude of the intake pressure of the air horn 34. The pressure in the air horn 34 is hereinafter referred to as "intake pressure". A pressure control valve 70 is provided in an air introducing path 68 from the air cleaner (not shown) to a path 66 which connects the middle constant pressure valve 64 to the sonic flow control valve 60. By using the above-mentioned constant pressure at the output of the valve 64 as a constant pressure source, the pressure acting on the sonic flow control valve 60 is changed depending only on an electrical signal applied to the pressure control valve 70 to thereby change the stroke displacement of a valve member 67 of the sonic flow control valve 60. The change-over valve 44 is supplied with the intake pressure at the portion 62 downstream of the throttle valve 32 through an on-off solenoid valve 72. When the on-off solenoid valve 72 is off, the atmospheric pressure from the air cleaner (not shown) acts on the change-over valve 44 through an opening 74, the valve 72 and a tube 76; while when the on-off solenoid valve 72 is on, the intake pressure at the opening 62 acts on the change-over valve 44 through a tube 78, the valve 72 and the tube 76. In the case where the intake pressure at the opening 62 acts on the change-over valve 44, the valve member 46 is closed and the valve member 48 opened, so that the constant pressure chamber 28 communicates with the exhaust manifold 52 through tubes 80 and 82. In the case where the atmospheric pressure acts on the change-over valve 44, on the other hand, the valve member 46 is opened and the valve member 48 closed, so that the constant pressure chamber 28 communicates with the air horn 34 at its portion 50 upstream of the throttle valve 32 and downstream of the venturi 18 through the tubes 80 and 84. The pressure in the constant pressure chamber 28 is kept always constant at a level lower than the atmospheric pressure by the function of the low constant pressure valve 38. Specifically, the pressure in the constant pressure chamber 28 is introduced to the diaphragm chamber of the low constant pressure valve 38 having a compression spring 86 so that, when the pressure in the chamber 28 becomes lower than a predetermined setting, a diaphragm 88 of the valve 38 is allowed to displace upward in the drawing against the compression spring 86. At the same time, a valve member 90 integral with the diaphragm 88 is also displaced upward, thus enlarging the area of the opening 40. Since the flow rate of gas passing through the opening 40 is constant, the pressure difference on both sides of the opening is reduced. In other words, if the pressure at or about the point A upstream of the gas flowing through the opening 40 is constant, the pressure of the constant pressure chamber 28 is increased toward the setting value. If the pressure in the constant pressure chamber 28 becomes higher than the setting value, on the contrary, the particular pressure causes the diaphragm 88 to move downward so as to displace the valve member 90 in the direction to lessen the opening area of the nozzle 40 so that the pressure in the constant pressure chamber 28 is reduced toward the setting value. The set pressure in the constant pressure chamber 28 cannot be reduced below the maximum value of the intake pressure of the engine. The pressure is thus required to be set at a value (lower than the atmospheric pressure) slightly higher than the intake pressure under such an operation condition of low engine speed with a large load at which the engine intake pressure is highest. The set pressure of the middle constant pressure valve 64 is also required to be set substantially equal to the set pressure of the low constant pressure valve 38. By determining the set pressure in this way, a constant set pressure of the constant pressure chamber 28 is obtained under every engine running condition, i.e., with every value of the intake pressure. Since the control fuel nozzle 26 opens in the constant pressure chamber 28, the pressure exerted on the nozzle 26 is always constant regardless of the engine running conditions, so that the flow rate of the control fuel depends solely on the operating condition of the fuel control actuator 24. In other words, the flow rate of the control fuel is controlled only by an electrical signal 91 applied to the fuel control actuator 24. The control fuel controlled to the desired flow rate by the fuel control actuator 24 is injected into the constant pressure chamber 28 by way of the control nozzle 26 by the predetermined pressure of the constant pressure chamber 28. However, since the pressure in the constant pressure chamber 28 is high as it approaches the atmospheric pressure, as mentioned above, and the gas velocity is low, the fuel injected from the nozzle 26 cannot be atomized. For this reason, the constant pressure chamber 28 communicates with the air horn 34 at its portion 36 downstream of the throttle valve 32 through the sonic flow nozzle 30. In other words, the diameter $d_1$ of the narrowest part of the sonic flow nozzle 30 and the proper enlarged angle $\theta$ and distance h (defined later) associated with the narrowest part diameter are so determined that the sonic flow of air may be achieved at the narrowest part of the sonic flow nozzle 30 even in the engine operating range of low engine speed with heavy load or cold start and complete combustion during cold start where the engine intake pressure is highest and the amount of the control air is greatest. In the operating range where the amount of control air is smaller than the abovementioned maximum, the narrowest part of the sonic flow nozzle 30 is apparently reduced in diameter by the sonic flow valve 60, so that the effective sectional area of the narrowest part of the sonic flow nozzle 30 is reduced, thus attaining the sonic flow. Generally, in the engine operating range where the control air is small in amount (such as under the light load at low engine speed), the engine intake pressure is sufficiently low to attain the sonic flow substantially regardless of the effective diameter of the narrowest part of the sonic flow nozzle 30. In such an operating range, therefore, by controlling the degree of lift of the sonic flow control valve 60, the desired amount of control air is attained while at the same time forming a sonic flow at the narrowest part thereof. In this way, the fuel injected into the constant pressure chamber 28 is atomized while passing through the sonic flow and mixed with the air controlled at a predetermined amount, and the mixture is then injected into the air horn 34 through the port 36 downstream of the throttle valve 32.

An experiment was conducted without any valve member 67 for changing the effective area of the narrowest part of the nozzle 30 or with the valve member 67 fully lifted up to completely open the narrowest part of the nozzle 30 so that the valve member 67 had no effect on the air flow rate. The result of this experiment shows that a satisfactory sonic flow was obtained even at the time of cold start with the considerably high intake pressure as high as 710 mmHg and the amount of air of 0.6 $m^3$/min flowing through the sonic flow nozzle, when the diameter $d_1$ of the narrowest part of the nozzle 30, the enlarged angle $\theta$ and the enlarged distance h were selected to be 6.12 mm$\phi$, 12° and 22.7 mm, respectively, in the case where the diameter $d_2$ of the widest part of the nozzle tube was 10.9 mm$\phi$. Here, the terms "enlarged angle" and "enlarged distance" are defined such that the former means the solid angle defined by the inner surface of the nozzle tube portion which follows the nozzle 30 and gradually increases its diameter from the minimum value $d_1$ to the maximum value $d_2$ and the latter means the distance or length between the two portions of the nozzle tube at which the diameters of the tube are $d_1$ and $d_2$ respectively.

Description was thus made of the configuration and the functions of the component parts of the embodiment shown in FIG. 1. Now, operation of the component parts under each engine running condition will be described in detail.

(1) DURING ENGINE COLD CRANKING

At the time of so-called engine cold cranking, namely at the time of engine start under such a condition of a low atmospheric temperature, the high viscosity of the engine lubrication oil leads to large frictional losses. Also, the commanded engine air-fuel ratio is as small as 8 to 10, thus requiring an air-fuel mixture which is high in fuel concentration. Since the temperature of the engine cooling water is very low, the fuel cannot be vaporized in an intake manifold of the hot water manifold type. Also in a system of heating the intake manifold confluence by the exhaust heat of the exhaust manifold or exhaust tube, heat transmission requires ten and several to several hundred seconds, thus making it impossible to evaporate the fuel in the intake manifold. For uniform distribution of the air-fuel mixture to the cylinders, therefore, the fuel injected from the carburetor is required to be atomized to promote the mixing with the supplied air.

According to this embodiment, the above-mentioned problem is solved in the manner mentioned below. Under this running condition, the exhaust gas recirculation may be of course zero. Therefore, an electrical signal 102 is applied from a control circuit 92 to the on-off solenoid valve 72 to turn off the same valve 72, so that the constant pressure chamber 28 is caused to communicate with the air horn 34 at the port 50 upstream of the throttle valve 32 and downstream of the venturi 18 by the change-over valve 44. Under this condition, the throttle valve 32 has an ordinary idling opening. The engine intake pressure is as high as about 700 mmHg almost equal to the set pressure of the middle constant pressure valve 64 as mentioned above, and therefore the middle constant pressure valve 64 is substantially full open so that the pressure thereof tends to be controlled at the set pressure. The pressure control valve 70 is impressed with an electrical signal 100 from the control circuit 92 in accordance with signals 94, 96 and 98 representing the detected values of the intake air, engine r.p.m. and temperature of engine cooling water respectively. Then the pressure acting on the sonic flow control valve 60 is controlled at the desired value, so that the lift of the sonic flow control valve 60 reaches the desired level, thus controlling the effective sectional area of the narrowest part of the sonic flow nozzle 30 to form a sonic flow. The pressure of the constant pressure chamber 28 is controlled to approach the set pressure by the low constant pressure valve 38. On the other hand, the fuel control actuator 24 is impressed with the electrical signal 91 from the control circuit 92 in accordance with the detection signals 94, 96 and 98 representing the amount of the air intake, engine r.p.m., and temperature of engine cooling water, thus controlling the control fuel flow rate at the desired level. The control fuel thus controlled is injected from the control nozzle 26 to the constant pressure chamber 28, atomized by and mixed with the air sonic flow at the sonic flow nozzle 30, and injected as in the form of air-fuel mixture into the air horn 34 at the portion 36 downstream of the throttle valve 32. In the process, the fuel from the main fuel system is not injected into the air horn because the throttle vavle is open for idling. In this way, even at the engine intake pressure as high as about 700 mmHg, an air flow velocity almost equal to the sonic velocity is attained at the sonic flow nozzle and therefore the atomization of the fuel is promoted, thus uniformly distributing the air-fuel mixture to the cylinders.

(2) COMPLETE COMBUSTION AND ENGINE HOT RUNNING

When the air-fuel mixture is supplied to each combustion chamber by cranking and starts to burn and explode there, it reaches the condition of what is called complete combustion followed by gradual transfer to hot running. After the complete combustion condition of the engine has been reached, the engine is gradually warmed up by the exhaust heat of combustion, and the viscosity of the engine lubrication oil is reduced, thus decreasing the frictional losses. The intake pressure which stood at about five hundred mmHg to over six hundred mmHg immediately after complete combustion is slowly reduced. Also, the demanded engine air-fuel ratio of 8 to 10 indicative of excessive fuel concentration is changed to a lower air-fuel ratio indicative of a smaller fuel concentration. Further, the absolute amount of the air-fuel mixture which stood about 5 to 7 times larger than that at the time of idling after engine warm up immediately following complete combustion when the engine is not yet completely warmed up is slowly reduced, so that the engine steadily approaches to the idling condition following the warm up.

The system according to the present invention operates as mentioned below under the above-mentioned running conditions. Since the exhaust gas recirculation may be zero under this running condition like the conditions at the time of cranking, the control circuit 92 produces an electrical signal 102 to turn off the on-off solenoid valve 72, so that the constant pressure chamber 28 communicates with the air horn 34 at the port 50 upstream of the throttle valve 32 via the tube 84. The opening of the throttle valve 32 is at idling level. In view of the fact that the intake pressure immediately after the complete combustion condition is attained is five hundred mmHg to over six hundred mmHg, each of the low constant pressure valve 38 and the middle constant pressure valve 64 may satisfactorily be controlled at a set valve. The control air must be increased to an amount about 5 to 10 times that at the time of idling following the warm up, and therefore the pressure control valve 70 is almost closed up, so that the pressure controlled at the set pressure of the middle constant pressure valve 64 is efficiently exerted on the sonic flow control valve 60. In response to this pressure, a diaphragm 104 of the sonic flow control valve 60 is displaced sufficiently against the force of a compression spring 106 disposed within the chamber, thus increasing the effective area of the diaphragm narrowest part of the sonic flow nozzle 30 to maximum. The diameter of the narrowest part of the sonic flow nozzle 30 is designed to attain the sonic flow even at such an air flow rate or intake pressure, thus building up the sonic flow at the narrowest part of the nozzle 30. The fuel controlled at the desired amount by the fuel control actuator 24 is thus led to the constant pressure chamber 28, atomized by and mixed with the sonic air flow, and injected at the port 36 downstream of the throttle valve through a tube 108. Under this condition, the valve member 90 of the low constant pressure valve 38 is displaced to a position maximizing the area of the opening 40 thereby to control the pressure within the constant pressure chamber 28 to the setting value.

With the gradual warm up of the engine after the complete combustion condition has been reached, the control circuit 92 senses the amount of air intake, engine r.p.m. and temperature of engine cooling water from the signals 94, 96 and 98 indicative of them and changes the status of the electrical signals 92 and 100 applied to the fuel control actuator 24 and the pressure control valve 70 in order to attain the air-fuel ratio of the air-fuel mixture suitable to these conditions. Specifically, in view of the need to lessen the amount of the control air gradually, the control signal 100 is changed to transfer the pressure control valve 70 from the closed-up state to the open state gradually, so that the sonic flow valve 60 is controlled to displace in a direction to reduce the effective area of the narrowest part of the sonic flow nozzle 30 gradually. In the process, the intake pressure is gradually reduced and therefore the sonic air flow is of course built up by the sonic flow nozzle 30. The control fuel flow rate is also required to be reduced gradually. For this purpose, the status of the control electrical signal 91 applied to the fuel control actuator 24 from the control circuit 92 is changed in order to change the state of the actuator 24 from its open state immediately after complete combustion to its closed state gradually. Also, the effective opening area of the nozzle 40 of the low constant pressure valve 38 is gradually reduced from the maximum value immediately after the complete combustion, thus controlling the pressure in the constant pressure chamber 28 to the set value. As a result, the amount of air and the fuel flow rate are regulated properly in accordance with the ever-changing engine conditions on the one hand and the atomization and mixing of the fuel are promoted by the sonic air flow at the sonic flow nozzle on he other hand.

(3) LOW-SPEED WITH LIGHT-LOAD RUNNING

In such engine running conditions as idling fully warmed up, low or middle engine speed running with no load, and running with a light load, where the intake pressure is comparatively low at 210 to 360 mmHg while the amount of intake air is comparatively small at 0.06 to 0.3 $m^3$/min, the air-fuel ratio is metered by the low speed fuel system in the conventional fixed venturi carburetors.

Under such operating conditions, the embodiment of the present invention under consideration operates in the manner mentioned below. Under this condition, the exhaust gas recirculation may also be zero in amount, and therefore the electrical signal 102 is applied from the control circuit 92 to the on-off solenoid valve 72 in such a manner as to turn off the valve 72, so that the constant pressure chamber 28 communicates with the air horn 34 at the port 50 upstream of the throttle valve 32 through the tubes 80 and 84. The throttle valve 32 is operatively interlocked with the accelerating operation of the operator. Since the intake pressure is low as mentioned above, the low constant pressure valve 38 and the middle constant pressure valve 64 may be controlled at the set pressure satisfactorily. The control air is always supplied in the amount several ten % of the amount of air metered by the throttle valve 32. If this proportion is excessive, the engine r.p.m. is increased temporarily above the value desired by the driver even when the driver depresses the accelerator and sets the throttle valve 32 at proper position, since the amount of air is detected and a certain proportion thereof is metered and supplied as a control air from the sonic flow control valve 60. Therefore, the driver must adjust the degree of depression of the accelerator in such a manner as to somewhat reduce the opening of the throttle valve 32 is order to achieve the desired amount of air and running conditions. This is equivalent to saying that if the control air is more than a certain proportion, it is impossible to attain the running conditions desired by the driver, resulting in hunting in the throttle valve 32 and the control system for the control air. Therefore, the proportion of the control air must be set below the amount causing hunting.

In this way, when the throttle valve 32 is open to an extent, the electrical signal 91 in such a state as to attain a proper proportion of the control air suitable for the opening is applied to the pressure control valve 70 from the control circuit 92, so that the sonic flow control valve 60 is displaced by the desired amount, thus controlling the amount of control air passing through the sonic flow nozzle 30 at the desired value. On the other hand, the flow rate of the control fuel is controlled at the desired amount by the fuel control actuator 24 for injection into the constant pressure chamber 28. Of course, the intake pressure is sufficiently low and therefore a sonic flow is formed at the sonic flow nozzle, thus actively atomizing and mixing of the fuel.

(4) OUTPUT OPERATING RANGE

Not only a great amount of fuel and a large air flow rate but also a high fuel concentration of about 12 in air-fuel ratio is required in the output operating range. Thus the opening of the throttle valve 22 is made sufficiently large and the intake pressure is lower than 660 mmHg.

According to the embodiment under consideration, these requirements are met by the operation mentioned below in the above-mentioned operating range. The main fuel system operates as in the conventional way, and the fuel in the amount proportional to the amount of air is injected from the main nozzle 20 by the intake pressure at the venturi 18 commensurate with the amount of air intake. Thus a great amount of fuel flow rate commensurate with the great amount of air intake is substantially supplied by this main fuel system. Since the operating range under consideration requires an air-fuel ratio higher in fuel concentration than in the ordinary partial loaded range, however, such a fuel increment is required to be supplied by the control fuel system. The intake pressure is lower than 660 mmHg which is lower than the set pressure of the low constant pressure valve 38 or the middle constant pressure valve 64, and therefore the pressure acting on the diaphragm chamber of the sonic flow control valve 60 and the constant pressure chamber 28 can be maintained at their set values. The amount of control air cannot be maintained constant at several ten percent of the amount of air metered by the throttle valve 32 unlike in the low-speed light-loaded operation, but is restricted by the effective area of the narrowest part of the sonic flow nozzle 60. As described above, this effective area is selected to be such that the sonic air flow is attained even when the amount of the control air is as large as 5 to 10 times that at the time of idling and the intake pressure is slightly lower than the atmospheric pressure or as high as, say, 740 mmHg as in the case of engine start warm-up condition. Therefore, in the above-mentioned output operating range where a great amount of air is required, it is difficult to supply several ten percent thereof at the sonic flow nozzle. In this operating range, therefore, the displacement of the sonic flow control valve 60 is maximized and the effective area of the narrowest part of the sonic flow nozzle 30 is maintained constant at its maximum value. In other words, the electrical signal 100 is applied in such a state as to close up the pressure control valve 70 from the control circuit 92 to the pressure control valve 70. In the output operating range, the amount of exhaust recirculation flow rate may be generally zero, and therefore the electrical signal 102 is applied from the control circuit 92 to the on-off solenoid valve 72 in such a state as to keep the valve 72 off, so that the constant pressure chamber 28 communicates with the air horn at the port 50 upstream of the throttle valve 32 through the tube 84. The control fuel may be supplied in the flow rate corresponding to the difference between the amount supplied by the main fuel system and the commanded amount, and therefore the running condition is detected by the amount of intake air and the engine r.p.m. and in order to correct the difference, the electrical signal 91 is applied from the control circuit 92 to that fuel control actuator 24, thus controlling the same at predetermined value. The fuel thus controlled is actively atomized by and mixed with the sonic air flow at the sonic flow nozzle 30 and injected as an air-fuel mixture at the port 36 downstream of the throttle valve 32.

(5) DECELERATING OPERATION RANGE

In the decelerating operation range, the throttle valve 32 has an idling opening or a similarly small opening and the engine is run in a sort of motoring mode by the inertia transmitted from the wheels, thus abnormally reducing the intake pressure to 110 to 210 mmHg. Since the air flow at the throttle valve 32 takes the form of a sonic flow at the intake pressure lower than 410 mmHg, however, the amount of air intake is almost the same as at the time of idling. The abnormal reduction in the intake pressure, however, presents the problems of intrusion of lubrication oil into the combustion chamber, deterioration of combustion and the after burn in the exhaust tube. These problems are solved according to the embodiment under consideration by the operation mentioned below. As in the operating ranges (1) to (4), the control electrical signal 102 in such a state as to reduce the exhaust gas recirculation to zero is of course applied from the control circuit 92 to the on-off solenoid valve 72. The experimental study made in various fields has made it clear that these problems are solved if the intake pressure is about 210 mmHg or higher at the time of deceleration. According to the present embodiment, air is supplied from the control air path thereby to control the intake pressure at about 210 mmHg only during the engine deceleration period when the intake pressure abnormally drops. The amount of the control air to be supplied is determined by the degree of deceleration and deceleration time. This decelerating condition is detected by the detection signals representing the amount of intake air and the engine r.p.m., so that the electrical signal 100 commensurate with that condition is applied from the control circuit 92 to the pressure control valve 70, thus controlling the amount of control air at the desired value. The optimum demand for the control fuel flow rate depends on the shape of the combustion chamber, the combustion system and the exhaust gas processing system. The electrical signal 91 is applied in such a state as to meet the optimum requirements from the control circuit 92 to the fuel control actuator 24, thus regulating the amount of the control fuel. If required, the flow rate of the control fuel may of course be reduced to zero.

(6) EXHAUST GAS RECIRCULATION AMOUNT CONTROL RANGE

As is well known, what is called the exhaust gas recirculation system (hereinafter referred to as EGR) is widely used with actual engines as a means for purifying nitrogen oxides (hereinafter referred to as NOx) contained in the exhaust gas, in which part of the exhaust gas is introduced into the intake manifold so that a gas comprising a mixture of fresh air and fuel and the part of exhaust gas is introduced to the combustion chamber, thus reducing the combustion temperature and the amount of NOx discharge.

Each engine running condition has an optimum amount of exhaust gas recirculation (hereinafter referred to as EGR amount). Specifically, the more the EGR amount, the less the NOx discharge amount, accompanied by a lower combustion efficiency and output. It is thus necessary to regulate the EGR amount elaborately to reduce the NOx discharge without decrease in the EGR amount for each running condition.

According to this embodiment, the EGR amount is regulated in the manner described below. The EGR is required to operate only in the high-speed light-load range and middle-load range except for the low-speed middle-load range, middle-speed light-load range and output operating range. The operating range in question correspond to the generally-called partial load operating range. This operating range is sensed by the detection of the amount of intake air, the engine r.p.m. and the temperature of the engine cooling water, so that electrical signals representing the detected amounts are applied to each actuator and control valve. The electrical signal 102 is applied from the control circuit 92 in such a state as to turn on the on-off solenoid valve 72, so that the constant pressure chamber 28 is made to communicate with the exhaust manifold 52. In this operating range, the intake pressure is comparatively low at from about two hundred and several ten to six hundred mmHg, and therefore both the low constant pressure valve 38 and the middle constant pressure valve 64 can of course be easily controlled at their set values. The electrical signal 91 applied to the fuel control actuator 24 is processed in the same manner as in the low-speed light-load operating range as mentioned above. With the increase in the control amount beyond a certain level, however, the resistant parts of metering and control throttling of the fuel control actuator 24 makes a further control impossible. In such an operating range, therefore, the electrical signal 91 is applied in such a state as to maintain the particular critical situation constant from the control circuit 92 to the actuator 24. On the other hand, in view of the fact that the EGR amount is controlled by the electrical signal 100 applied to the pressure control valve 70 in this operating range, the electrical signal 100 is required to be applied from the control circuit 92 to the pressure control valve 70 in such a state as to maintain the optimum EGR amount. Thus the EGR amount is controlled by the sonic flow control valve 60 in this case.

Explanation was made above of the operation of the embodiment in each operating range described in detail with reference to (1) to (6) above. In the above explanation, a method was described in which the signals 98, 94 and 96 indicative of the intake air amount, the engine r.p.m. and the temperature of engine cooling water were used as the signals detecting the engine running conditions. As an alternative, signals indicative of the opening of the throttle valve or intake pressure may of course be utilized as signals representing the amount of air intake associated with the engine r.p.m. Further, the control circuit 92 often referred to in the above explanation includes a memory, an input-output device and a processor as described again later with reference to FIG. 4. The input device of the control circuit 92 may be supplied with the engine running condition detection signals 94, 96 and 98 and these signals may be stored in the memory as optimum signal for the particular running conditions, so that they may be produced to the individual actuators and control valves from the processor through the output device for the purpose of control.

As explained above, the electronically-controlled carburetor according to this invention is capable of proper air-fuel ratio control by the electrical means over the entire operating range.

In the case where the EGR amount control is not required, it is not necessary to provide the air path from the exhaust manifold 52, the change-over valve 44, the solenoid valve 72, etc. Instead, the opening 50 to the air horn may be communicated with the constant pressure chamber 28 through the opening 40.

Figure 2:
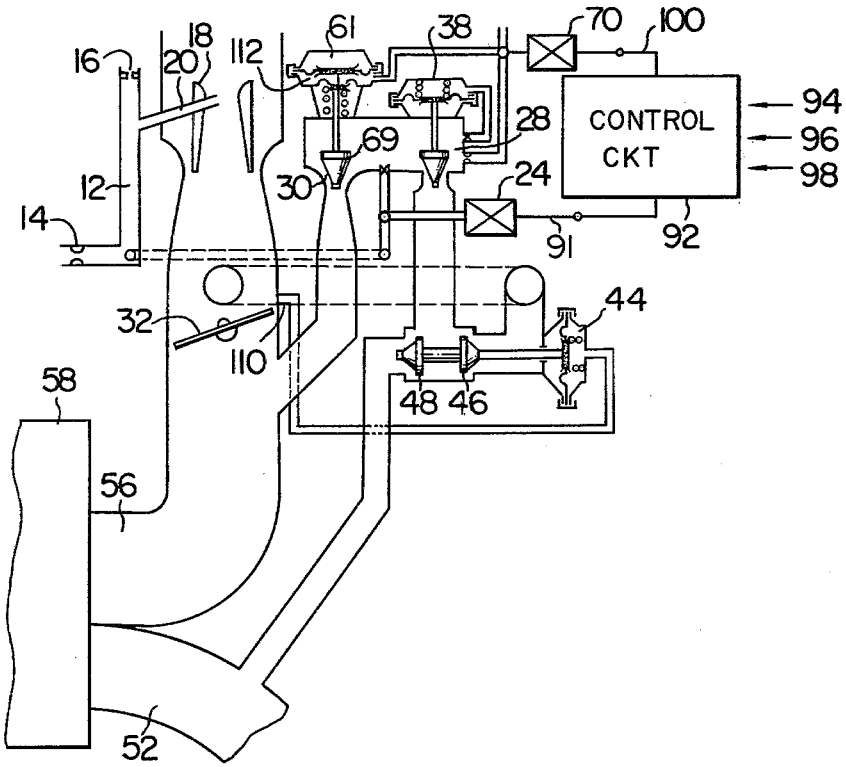
FIG. 2 is a diagram for explaining the essential parts of the electronic control system of the carburetor as another embodiment of the present invention.

The diagram of FIG. 2 is for explaining the electronic control of the carburetor according to another embodiment of the present invention, which is different from the embodiment of FIG. 1 in that the number of control valves is reduced. The system of FIG. 1 uses a total of seven control valves: i.e., four control valves utilizing a diaphragm including the sonic flow control valve 60, the low constant pressure valve 38, the middle constant pressure valve 64 and the change-over valve 44, and three control valves utilizing solenoid valves including the fuel control actuator 24, the pressure control valve 70 and the on-off solenoid valve 72, thus complicating the construction on the one hand and increasing the cost on the other hand. In this embodiment, on the contrary, the number of control valves is decreased to simplify the construction. First, the pressure acting on the change-over valve 44 is derived from an intake pressure detecting port 110 opened to such a portion that it communicates with the upstream of the throttle valve 32 at the idling opening of the throttle valve 32 and opens at a position downstream of the throttle valve 32 at larger throttle valve openings. In other words, this change-over valve 44 may cause the exhaust manifold 52 to communicate with the constant pressure chamber 28 only in the EGR operating range. In the low-speed light-load operating range, the throttle opening is small and the intake pressure detection port 110 is situated upstream of the throttle valve 32, so that a pressure substantially equal to the atmospheric pressure prevails. The spring force of the change-over valve 44 is larger, and therefore the valves 46 and 48 are displaced leftward so that the constant pressure chamber 28 fails to communicate with the exhaust manifold 52, thus reducing the EGR amount to zero. In the output operating range, the intake pressure is higher than about 660 mmHg as well known. The force of the compression spring in the diaphragm chamber of the change-over valve 44 should be set in such a manner as not to succumb to such an intake pressure. In other words, the EGR amount is zero in both of the above operating ranges. In the other conditions of what is called partial load operating range, the change-over valve 44 is controlled so that the constant pressure chamber 28 communicates with the exhaust manifold 52. In this case, the change-over valve 44 may be operated as shown in FIG. 1 by use of the on-off solenoid valve 72 operated in response to the output signal 102 produced from the control circuit 92.

By so doing, the middle constant pressure valve 64 shown in FIG. 1 may be eliminated. The constant pressure in the constant pressure chamber 28 is introduced to the pressure control valve 70, thereby causing the pressure thus controlled to act on a sonic flow control valve 61. The sonic flow control valve 61, unlike in FIG. 1, has two diaphragms, small and large. The controlled pressure from the pressure control valve 70 is introduced to a pressure chamber 112 defined by the two diaphragms. When the controlled pressure increases, the sonic flow nozzle valve member 69 is displaced downward, thus narrowing the gap of the nozzle 30. When the controlled pressure decreases, on the other hand, the reverse is the case. Thus the sonic flow control valve 61 in the embodiment under consideration has the characteristics reverse to those of the sonic flow control valve 60 shown in FIG. 1.

This is to prevent the sonic flow control valve 61 from being closed even when the intake pressure becomes higher than the set value in the constant pressure chamber 28 in the low-speed light-load operating range or the like. The control electrical signal 100 produced from the control circuit 92 to the pressure control valve 70 also acts reversely to that shown in FIG. 1. The other component elements and their operation are the same as those in the embodiment of FIG. 1.

The electronically-controlled carburetor according to this embodiment has the same advantage as the embodiment of FIG. 1 and has a simpler construction than the embodiment of FIG. 1.

Figure 3:
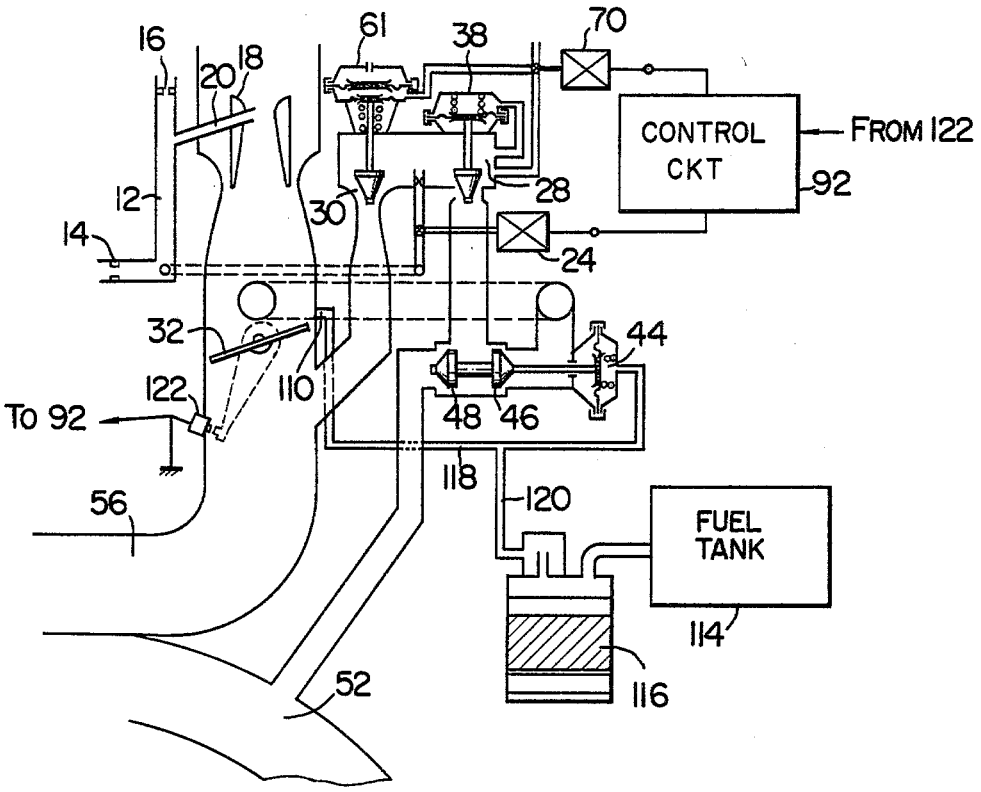
FIG. 3 is a diagram for explaining the essential parts of the electronic control system of the carburetor representing an application of the system of FIG. 2.

FIG. 3 is a diagram for explaining an electronically-controlled carburetor to which the device of FIG. 2 is applied, in which the component elements similar to those in FIG. 2 are denoted by like reference numerals. In the prior art, the evaporated fuel in the fuel tank is introduced to the air cleaner section (not shown) at the upper part of the air horn. In the case where the amount of intake air is detected by a heat ray sensor and the signal representing a detected value is used to control the fuel amount, however, the heat ray sensor is likely to be contaminated by the fuel vapor or the detection signal fails to indicate the true amount of intake air. To improve these shortcomings, the embodiment under consideration is so constructed that the fuel gas evaporated in the fuel tank is introduced to the air horn between the venturi and the throttle valve.

The upper part of a fuel tank 114 is connected to a fuel vapor adsorber container 116 where the evaporated fuel gas is adsorbed to a filler. This fuel vapor adsorber container 116 communicates through a tube 120 to a tube 118 having an intake pressure detecting aperture 110 opened directly above the throttle valve 32. When the pressure at the intake pressure detecting aperture 110 decreases below the atmospheric pressure, therefore, the fuel vapor adsorbed to the fuel vapor adsorber container 116 is released therefrom and introduced to the air horn through the detecting aperture 110. In this case, the engine is running at high speed requiring a comparatively large amount of fuel, and therefore the air-fuel ratio of the mixture gas is hardly affected.

To meet the requirement for cutting off the control fuel at the time of deceleration, a throttle valve switch 122 is provided for detecting the engine r.p.m. at such a time. Upon detection of the decelerating condition by the throttle valve switch 122, the detection signal is applied to the control circuit 92, thus stopping fuel supply.

The electronically-controlled carburetor according to this application has the same advantages as those shown in FIG. 2, and another advantage thereof is that the fuel vapor in the fuel tank can be introduced to a place not adversely affecting the detection of intake gas amount and the fuel supply can be stopped at the time of deceleration.

Figure 4:
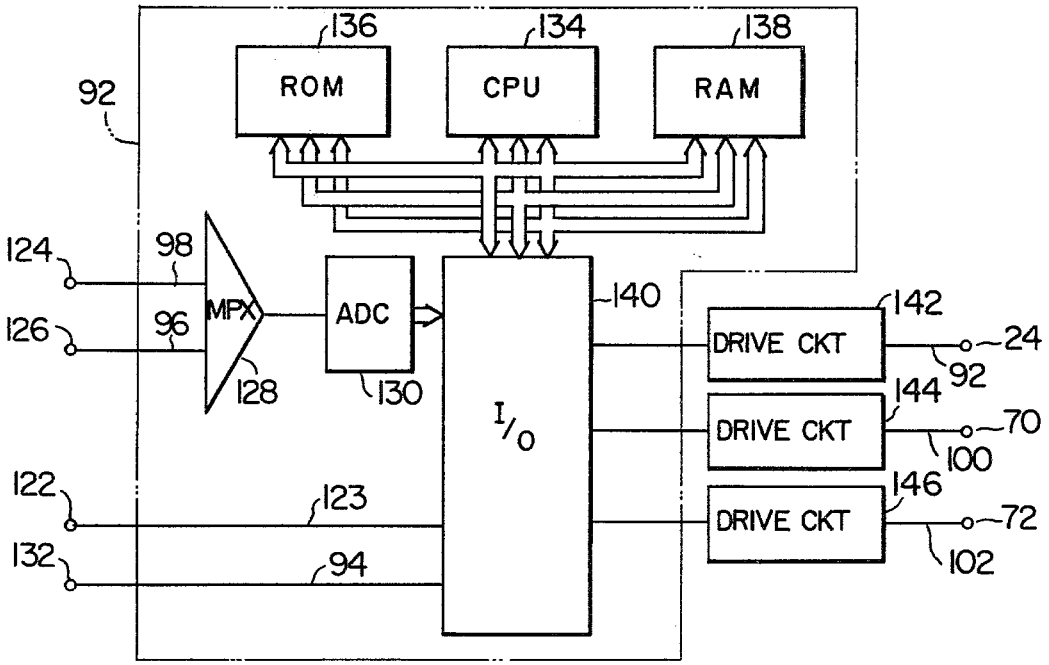
FIG. 4 is a block diagram showing a control circuit.

A known control circuit may be used as the control circuits of FIGS. 1, 2 and 3, as the configuration thereof is shown in the block diagram of FIG. 4. The input signals to this control circuit are roughly classified into three types. First, analog inputs 98 and 96 are transmitted from a sensor 124 for detecting the intake air amount and a sensor 126 for detecting the temperature of the engine cooling water. These analog input signals are applied to a multiplexer 128 (hereinafter referred to as MPX) for selecting the outputs of the sensors by time division and applying them to an analog-digital converter 130 (hereinafter referred to ADC), where they are converted into digital values. Secondly, information is applied in the form of an on-off signal. An example is a signal 123 applied from the throttle switch 122 (FIG. 3) for detecting the idling opening position of the throttle valve 32. This signal may be handled as a 1-bit digital signal. Thirdly, a train of pulses is applied, an example being a reference crank angle signal (hereinafter referred to as CRP) used as an engine r.p.m. signal. CRP is sent from a crank angle sensor 132 in the form of the signal 94.

CPU 134 is a central processing unit for digital procession, ROM 136 is a read-only memory for storing a control program and a fixed data, and RAM 138 is a memory capable of read and write operations. An input-output interface circuit 140 receives the input signal from the ADC 130 and sensors 122 and 132 and sends signals to CPU 134. CPU 134 processes these signals in cooperation with the RAM 138 and ROM 136 and applies various control signals to a drive circuit 142 for the fuel control actuator 24, another drive circuit 144 for the pressure control valve 70 and still another drive circuit 146 for the on-off solenoid valve 72. The circuits and elements making up the control circuit are of course impressed with the source voltage though not shown in the drawings.

As explained with reference to the above embodiments, proper air-fuel ratio control has been made possible in all engine operating conditions by the electronic control devices using a microcomputer or the like. In these electronic control devices, the air-fuel ratio control characteristics may be easily changed by changing the circuit constants or the pattern stored in the memory. Further, the use of the low-speed fuel system, the starting system and the output system or deceleration system of the prior art carburetor have been eliminated, and according to this embodiment, these functions and all EGR functions are performed by a series of electronic control systems. This realizes an air-fuel ratio control system for the carburetor comparatively low in cost with an improved performance.

The electronically-controlled carburetor according to the present invention has the advantage that proper air-fuel ratio control is possible for all the ranges of engine running conditions.

We claim:

1. An electronically-controlled carburetor for an internal combustion engine, comprising:

an air horn connected between an external air cleaner and an intake manifold of the engine and having a venturi section provided upstream of an internal fluid path of the air path and a throttle valve provided downstream of the same fluid path;

a float chamber for containing a liquid fuel;

a main fuel path having a main nozzle opened to said venturi section, for introducing a main liquid fuel supplied from said float chamber into said air horn through said main nozzle;

a constant pressure chamber;

first means for maintaining the internal pressure of said constant pressure chamber at a predetermined value lower than the atmospheric pressure;

a control fuel path for introducing a control liquid fuel supplied from said float chamber, into said constant pressure chamber;

second means for controlling the amount of said control liquid fuel that passes through said control fuel path;

third means for introducing the control liquid fuel introduced into said constant pressure chamber, into said air horn in the neighborhood of said throttle valve; and electronic control circuit means for generating a first electrical control signal and applying said first electrical control signal to said second means so that the amount of said control liquid fuel passing through said control fuel path is controlled in a manner so that the air-fuel ratio of the fuel supplied to the engine is adjusted in accordance with the running conditions of the engine.

2. An electronically-controlled carburetor according to claim 1, further comprising fourth means for introducing part of a gas in said air horn into said constant pressure chamber and fifth means for controlling the amount of said gas introduced into said constant pressure chamber, said control fuel introduced to said constant pressure chamber being introduced into said air horn by said third means in the form of an air-fuel mixture containing the gas introduced to said constant pressure chamber by said fourth means.

3. An electronically-controlled carburetor according to claim 2, wherein said thrd means includes nozzle means for injecting said air-fuel mixture into said air horn as a sonic flow.

4. An electronically-controlled carburetor according to claim 3, wherein said third means includes movable valve means for controlling the effective area of a nozzle opening of said nozzle means, and valve position control means impressed with a second electrical control signal generated from said electronic control circuit means for controlling the position of said movable valve means in order to define the effective opening area of said nozzle according to the running conditions of the engine.

5. An electronically-controlled carburetor according to claim 4, wherein said third means includes tube means for communicating from said constant pressure chamber through said nozzle opening to said air horn at a portion downstream of said throttle valve.

6. An electronically-controlled carburetor according to claim 2, 3, 4 or 5, wherein said first means includes a gas-introducing opening provided at said constant pressure chamber, said fourth means introducing said gas in said air horn into said constant pressure chamber through said gas-introducing opening, gas introduction opening control valve means for controlling the effective area of said gas-introducing opening thereby to control the gas introduced therethrough, and means for moving said gas introduction opening control valve means for controlling the pressure in said constant pressure chamber in response to changes in said pressure.

7. An electronically-controlled carburetor according to claim 4, wherein said valve position control means includes a diaphragm-type valve actuator and a solenoid valve for introducing the atmospheric pressure into said actuator, the operation of said solenoid valve being controlled by said second electrical control signal.

8. An electronically-controlled carburetor according to claim 7, wherein said diaphragm-type actuator includes a diaphragm connected to said movable valve means, a first chamber opened to the atmosphere, and a second chamber isolated from said first chamber by said diaphragm and having a diaphragm spring for biasing said diaphragm toward said first chamber, said second chamber being communicated with a predetermined pressure source lower in pressure than the atmospheric pressure on the one hand and with said external air cleaner through said solenoid valve on the other hand.

9. An electronically-controlled carburetor according to claim 8, wherein said predetermined pressure source includes a diaphragm-type constant pressure valve communicating with said air horn at points upstream and downstream of said throttle valve respectively.

10. An electronically-controlled carburetor according to claim 8, wherein said predetermined pressure source is said constant pressure chamber.

11. An electronically-controlled carburetor according to claim 1, further comprising fourth means for introducing part of said gas in said air horn between said venturi section and said throttle valve, into said constant pressure chamber, fifth means for introducing part of the exhaust gas from said engine into said constant pressure chamber, and sixth means for controlling the amount of the gas to be introduced into said constant pressure chamber by said fourth and fifth means, the control fuel introduced to said constant pressure chamber being further introduced into said air horn by said third means as an air-fuel mixture containing the gas introduced to said constant pressure chamber by said fourth and fifth means.

12. An electronically-controlled carburetor according to claim 11, wherein said third means includes nozzle means for injecting said air-fuel mixture into said air horn as a sonic flow.

13. An electronically-controlled carburetor according to claim 12, wherein said third means includes movable valve means for controlling the effective area of a nozzle opening of said nozzle means, and valve position control means impressed with a second electrical control signal generated from said electronic control circuit means for controlling the position of said valve means in order to define the effective opening area of said nozzle according to the running conditions of the engine.

14. An electronically-controlled carburetor according to claim 13, wherein said third means includes tube means for communicating from said constant pressure chamber through said nozzle opening to said air horn at a portion downstream of said throttle valve.

15. An electronically-controlled carburetor accoding to claim 11, 12, 13 or 14, wherein said first means includes a gas introduction opening provided at said constant pressure chamber for introducing into said constant pressure chamber the gas in said air horn supplied by said fourth means and the exhaust gas of the engine supplied by said fifth means, a gas introduction opening control movable valve means for controlling the effective area of said gas introduction opening, and means for moving said gas introduction opening control movable valve means for controlling the pressure in said constant pressure chamber at said predetermined value in response to changes in said pressure.

16. An electronically-controlled carburetor according to claim 13, wherein said valve position control means includes a diaphragm-type valve actuator and a solenoid valve for introducing the atmospheric pressure into said actuator, the operation of said solenoid valve being controlled by said second electrical control signal.

17. An electronically-controlled carburetor according to claim 16, wherein said diaphragm-type actuator includes a diaphragm connected to said movable valve means, a first chamber opened to the atmosphere, and a second chamber isolated from said first chamber by said diaphragm and having a diaphragm spring for biasing said diaphragm toward said first chamber, said second chamber communicating with a predetermined pressure source lower in pressure than the atmospheric pressure on the one hand and with said external air cleaner through said solenoid valve on the other hand.

18. An electronically-controlled carburetor according to claim 17, wherein said predetermined pressure source includes a diaphragm-type constant pressure valve communicating with said air horn at points upstream and downstream of said throttle valve respectively.

19. An electronically-controlled carburetor according to claim 17, wherein said predetermined pressure source is said constant pressure chamber.

20. An electronically-controlled carburetor according to claim 15, wherein said sixth means includes a switching valve chamber having two inlet ports and one outlet port, movable switching valve means arranged in said switching valve chamber and adapted to communicate said outlet port selectively with one of said two inlet ports, and switching valve actuator means for causing said switching valve means to select one of said two inlet ports according to the running conditions of the engine in response to a third electrical control signal supplied from said electronic control circuit means, said outlet port communicating with said gas introduction opening of said constant pressure chamber, one of said two inlet ports communicating with said air horn at a point between said throttle valve and said venturi section, the other of said inlet ports communicating with an exhaust manifold of said engine.

21. An electronically-controlled carburetor according to claim 20, wherein said switching valve actuator means includes a diaphragm-type actuator having a diaphragm operatively connected to said switching valve means, and an on-off solenoid valve for communicating said diaphragm-type actuator with alternatively selected one of a tube communicating with said air horn at a point downstream of said throttle valve and a tube communicating with said air cleaner in response to said third electrical control signal.

22. An electronically-controlled carburetor according to claim 15, wherein said sixth means includes a switching valve chamber having two inlet ports and one outlet port, movable switching valve means arranged in said switching valve chamber for communicating said outlet port with selected one of said two inlet ports, means for detecting the internal pressure of said air horn in the vicinity of said throttle valve, and a switching valve actuator for causing said switching valve means to select one of said inlet ports in response to the output of said pressure detector means, said outlet port communicating with said gas introduction opening of said constant pressure chamber, one of said inlet ports communicating with said intake cylinder at a portion between said throttle valve and said venturi section, the other of said inlet ports communicating with an exhaust manifold of said engine.

23. An electronically-controlled carburetor according to claim 22, wherein said switching valve actuator is a diaphragm-type valve actuator having a diaphragm operatively connected with said switching valve means, and said pressure detector means is a tube for exerting the internal pressure of said air horn on said diaphragm by causing said diaphragm-type valve actuator to communicate with said air horn in the vicinity of said throttle valve.

24. An electrically-controlled carburetor according to claim 1, 2 or 11, wherein said control fuel path is opened directly to said float chamber.

25. An electronically-controlled carburetor according to claim 1, 2 or 11, wherein said control fuel path branches from said main fuel path and communicates with said float chamber through a part of said main fuel path.

26. An electronically-controlled carburetor according to calim 1, 2 or 11, wherein said constant pressure chamber is arranged in such a position that it is located higher than the oil level of said float chamber, in use.

27. An electronically-controlled carburetor according to claim 1, 2 or 11, wherein said running conditions of said engine are transmitted to said electronic control circuit means in the form of at least one of signals including an external electrical signal indicative of the amount of air taken into said air horn, an external electrical signal indicative of the rotational speed of said engine and an external electrical signal indicative of the temperature of the cooling water of said engine.

28. An electronically-controlled carburetor according to claim 27, wherein said external electrical signal indicative of the amount of air includes an external electrical signal indicative of the pressure in said air horn in the vicinity of said throttle valve, and said amount of air is determined in association with said external electrical signal indicative of the rotational speed of said engine.

29. An electronically-controlled carburetor according to claim 27, wherein said external electrical signal indicative of the amount of air includes an external signal indicative of the opening of said throttle valve, and the amount of air is determined in association with said external electrical signal indicative of the rotational speed of said engine.

* * * * *